US005517761A

United States Patent [19]

Wang

[11] Patent Number: 5,517,761

[45] Date of Patent: May 21, 1996

[54] SCISSORS WITH AN IDENTIFICATION ATTACHMENT

[76] Inventor: Ming-Lu Wang, No. 6-58, Jyu Chung Lane, Pai Sha Village, Hua Tan Hsiang, Chang Hua County, Taiwan

[21] Appl. No.: 374,980

[22] Filed: Jan. 19, 1995

[51] Int. Cl.[6] ..... B26B 13/00

[52] U.S. Cl. ..... 30/254; 30/341; D8/57

[58] Field of Search ..... 30/254, 232, 341, 30/340; D8/53, 57, 58

[56] References Cited

U.S. PATENT DOCUMENTS

D. 77,223 12/1928 Ern ..... D8/53
D. 297,207 8/1988 Hayashi ..... D8/57

FOREIGN PATENT DOCUMENTS 624436 11/1994 European Pat. Off. ..... 30/254

*Primary Examiner*—Douglas D. Watts
*Attorney, Agent, or Firm*—Beveridge, DeGrandi, Weilacher & Young

[57] ABSTRACT

A pair of scissors with an identification attachment for distinction and decoration, comprising two blades, two injection molded handles respectively put onto the two blades at their lower parts, two halves of a slot respectively made at the opposing inner sides of the two handles on the front face or even on each of the front and back faces to form a complete slot, a plurality of pins (or pin holes) disposed on one of the two halves, and a marking piece shaped like that of the slot but smaller in size and having a plurality of pin holes (or pins) on the underside corresponding to the pins (or pin holes) disposed on one of the two halves, so that the marking piece can be inlaid to properly cover the two halves of the slot for identification purpose when tile two handles are closed.

2 Claims, 3 Drawing Sheets

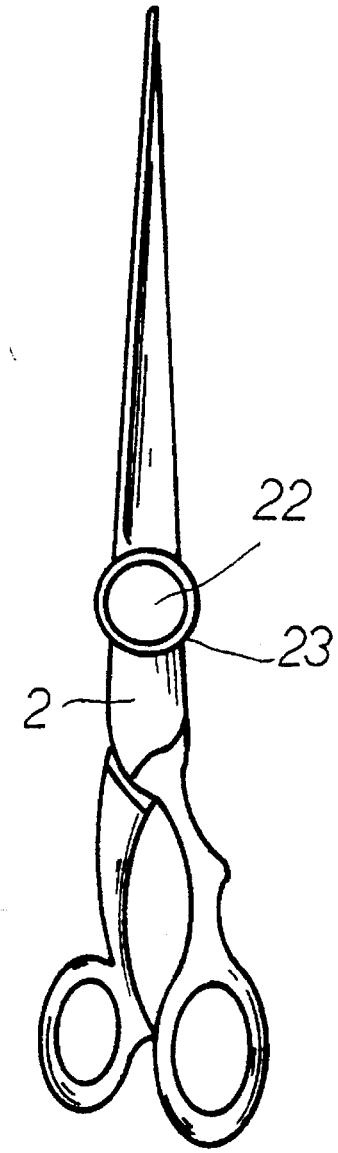
FIG. 1
(PRIOR ART)
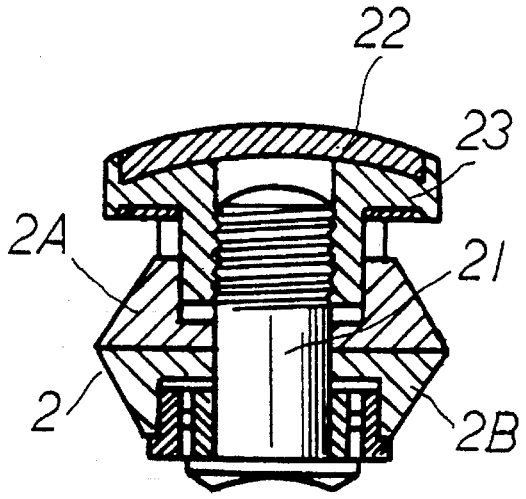
FIG. 1-A
(PRIOR ART)

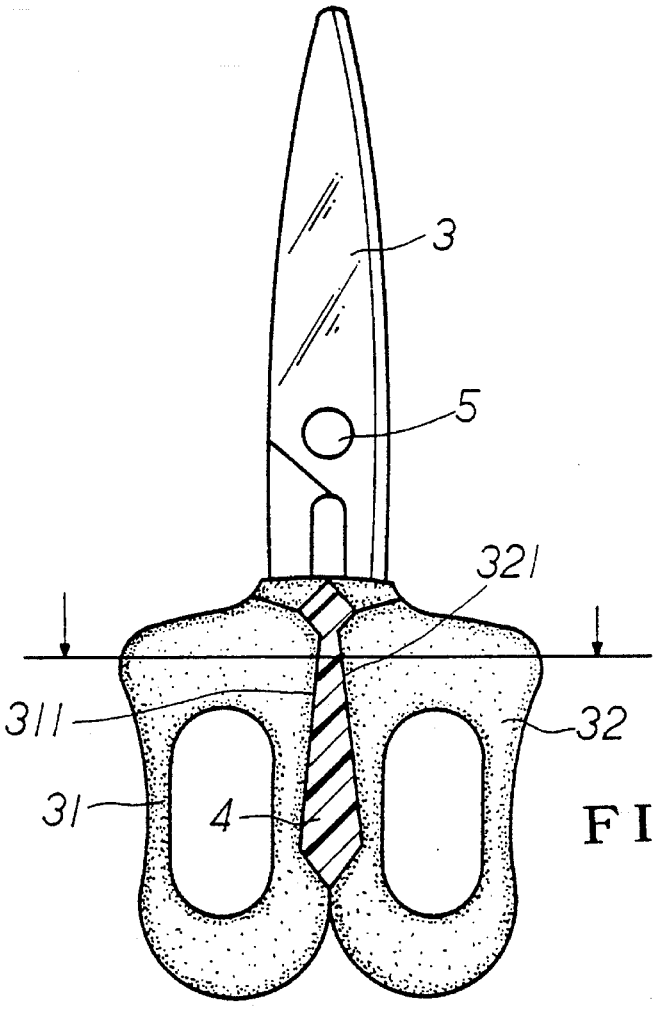
FIG. 4
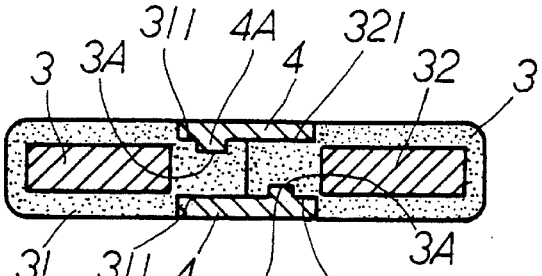
FIG. 5–A
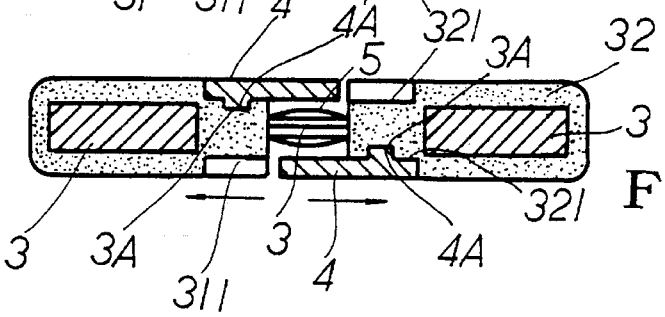
FIG. 5–B

SCISSORS WITH AN IDENTIFICATION ATTACHMENT

BACKGROUND OF THE INVENTION

The present invention relates to a pair of scissors with an identification attachment, and more particular to a pair of scissors with an identification attachment in which a marking piece of specified color or pattern can be easily inlaid into the opposing joint parts of the handles at their respective inner sides for a combination effect of identification, marking and decoration.

According to the prior art scissors, their handles are usually made by molded plastics in different colors for identification when they are used in a workroom. Due to the difficulty in dyeing and material change during the operation of plastic molding, however, the handles for the scissors of same model are few in color (black and brown colors are, in practice, those which are most commonly used, and orange color is seen once in a while). Therefore, if same model of scissors with same-colored handles are used in a workroom, it often puts the users to great inconvenience when it is intended to identify the respective ownerships or uses of these scissors. Though some users may put labels on these scissors for identification purpose, the labels are likely to be torn off, replaced or peeled off, the effect for identification is not good.

In order to improve the aforesaid disadvantages, as shown in FIGS. 1 and 1-A, it has been conceived to add a button element 22 in different color to a pivot pin 21 of the scissors 2 for identification purpose. To that end, however, the pivot pin 21 must be specially constructed to be different from conventional ones at its top or bottom for inlaying or fitting the button element 22 therein. For example, as shown in FIG. 1-A, the button element 22 is inlaid into a specially made pivot pin head 23. In such a manner, the assembly of two blades 2A, 2B of the scissors 2 becomes complicated and inconvenient, making these two blades 2A, 2B unable to be precisely closed, thereby negatively affecting the sharpness of the scissors 2.

SUMMARY OF THE INVENTION

The present invention has been accomplished under the aforesaid circumstances. It is the main object of the present invention to provide a pair of scissors with an identification attachment, wherein a detachable marking piece is inlaid into a slot cut at the opposing inner sides of the handles of the scissors for identification, marking and distinction. The marking piece is disposed separated from a pivot of the blades of the scissors, in order not to cause any inconvenience to the cutting operation of the blades or the assembly of the scissors.

It is another object of the present invention to provide a pair of scissors with an identification attachment, wherein a marking piece is inlaid in such a manner that its half side is fixed and its other half side is left projected laterally, so as to fully cover a slot cut at the opposing inner sides of the handles of the scissors.

It is still another object of the present invention to provide a pair of scissors with an identification attachment, wherein a marking piece may be made in the shape of, for example, a necktie, and two handles of the scissors be made together in the shape of, for example, a shirt, so that when the marking piece is inlaid in place and the handles are closed, it looks like a shirt wearing a necktie to produce a humorous sense of beauty.

BRIEF DESCRIPTION OF THE DRAWINGS.

FIG. 1 is a plan view showing a pair of scissors according to the prior art;

FIG. 1-A is a sectional view of a pivoting position of the scissors shown in FIG. 1;

FIG. 4 is a plan view showing the assembled scissors with an identification attachment of FIG. 2;

FIG. 5-A is a sectional view showing the relation of the identification attachment with the scissors when the scissors with an identification attachment according to the present invention is closed; and FIG. 5-B is a sectional view showing the relation of the identification attachment with the scissors when the scissors with an identification attachment according to the present invention is opened.

DETAILED DESCRIPTION OF THE PREFERRED EMBODIMENT

Figure 2:
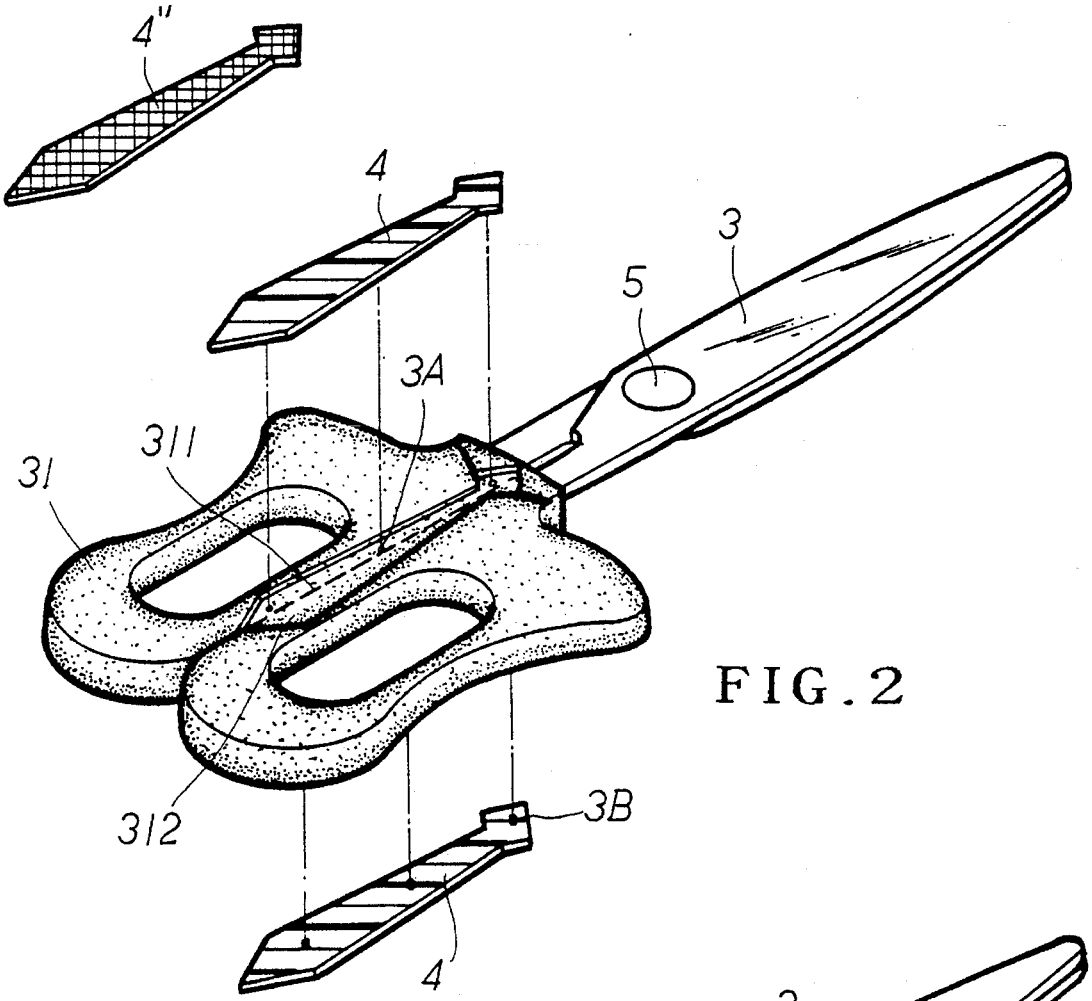
FIG. 2 is an exploded view showing a pair of scissors with an identification attachment according to the present invention.
Figure 3:
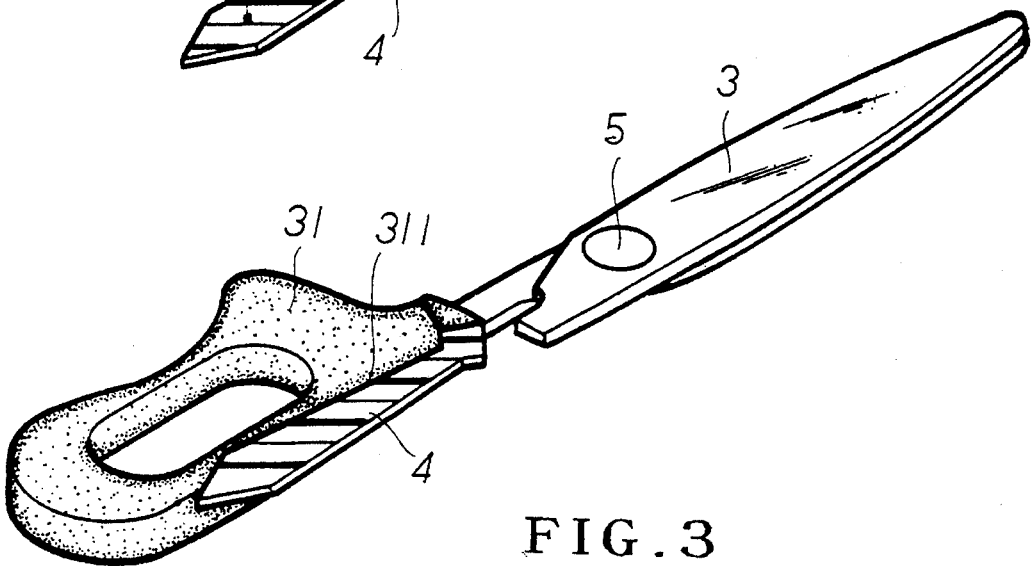
FIG. 3 is a perspective view showing part of the assembled scissors with an identification attachment of FIG. 2.

Referring to FIGS. 2, 3 and 4, a pair of scissors with an identification attachment according to the present invention is generally comprised of two blades 3, two injection molded handles 31, 32 put onto the respective blades 3 at their lower parts, two halves 311, 321 of a slot respectively made at the opposing inner sides of the handles 31, 32 on the front face or even on each of the front and back faces to form a complete slot, a plurality of pins (or pin holes) 3A disposed on the half 311 (or 321), and a marking piece 4 shaped like that of the complete slot but smaller in size. The marking piece 4 is provided having a plurality of pin holes (or pins) 3B on the underside corresponding to the pins (or pin holes) of the half 311 (or 321) of the slot, so that a half side of the marking piece 4 can be inlaid in the half 311 (or 321) of the handle 31 (or 32), and the other half side is left projected laterally from the half 311 (or 321), as shown in FIG. 3. When the handles 31, 32 are closed, the other half side thus projected engages with the half 321 (or 311) of the slot to adequately cover the complete slot formed by the halves 311, 321 after the handles 31, 32 have been closed (As shown in FIGS. 4, 5-A and 5-B).

As it is very easy to inlay the marking piece 4 according to the present invention, one can select any specific color or pattern for the marking piece 4 (or 4") as an identification for personal or particular use. Moreover, conventional scissors have become flat and dull in their design. In order to improve it, as shown in FIGS. 2, 3, 4 and 5, the marking piece 4 according to the present invention may be made in the shape of, for example, a necktie, and the handles 31, 32 be made together in the shape of, for example, a shirt, so that when the marking piece 4 is inlaid in place and the handles 31, 32 are closed, it looks like a shirt wearing a necktie to produce a humorous sense of beauty. In addition, as seen from FIGS. 5-A and 5-B, the position where the marking piece 4 is inlaid does not negatively affect the opening and closing of the handles 31, 31, and is separated from a pivot 5 of the blades 3 in order not to cause any inconvenience to the cutting operation of the blades 3 or the assembly of the scissors. Hence, the scissors with an identification attachment according to the present invention is simple in design, easy and efficient in use.

While only one embodiment of the present invention has been shown and described, it will be understood that various changes and modifications could be made without departing from the spirit and scope of the invention.

What is claimed is:

1. A pair of scissors with an identification attachment, comprising two blades, two injection molded handles respectively put onto said blades at their lower parts, two halves of a slot respectively made at the opposing inner sides of said handles on the front face or even on each of the front and back faces to form a complete slot, a plurality of pins disposed on one of said halves, and a marking piece shaped like that of said slot but smaller in size and having a plurality of pin holes on the underside corresponding to said pins disposed on one of said halves, whereby said marking piece can be inlaid to properly cover said halves of said slot for identification purpose when said handles are closed.

2. A pair of scissors with an identification attachment, comprising two blades, two injection molded handles respectively put onto said blades at their lower parts, two halves of a slot respectively made at the opposing inner sides of said handles on the front face or even on each of the front and back faces to form a complete slot, a plurality of pin holes disposed on one of said halves, and a marking piece shaped like that of said slot but smaller in size and having a plurality of pins on the underside corresponding to said pin holes disposed on one of said halves, whereby said marking piece can be inlaid to properly cover said halves of said slot for identification purpose when said handles are closed.

* * * * *